US006707238B2

(12) United States Patent
Bachetzky et al.

(10) Patent No.: US 6,707,238 B2
(45) Date of Patent: Mar. 16, 2004

(54) COMPACT LOW-PRESSURE DISCHARGE LAMP

(75) Inventors: Bruno Bachetzky, Augsburg (DE); Andreas Jakob, Langerringen (DE); Paul Lange, Friedberg (DE); Thomas Noll, Kipfenberg (DE)

(73) Assignee: Patent-Treuhand-Gesellschaft fur Elektrisch Gluhlampen mbH, Munich (DE)

( * ) Notice: Subject to any disclaimer, the term of this patent is extended or adjusted under 35 U.S.C. 154(b) by 0 days.

(21) Appl. No.: 10/320,538

(22) Filed: Dec. 17, 2002

(65) Prior Publication Data

US 2003/0117056 A1 Jun. 26, 2003

(30) Foreign Application Priority Data

Dec. 20, 2001 (DE) ..... 101 63 166

(51) Int. Cl.[7] ..... H01J 17/16; H01J 61/30

(52) U.S. Cl. ..... 313/318.01; 313/318.04; 313/318.11; 313/493; 313/113

(58) Field of Search ..... 313/318.01, 318.03, 313/318.04, 318.08, 318.11, 493

(56) References Cited

U.S. PATENT DOCUMENTS 5,751,104 A * 5/1998 Souls et al. ..... 313/493
6,008,570 A 12/1999 Helbig et al.
6,020,682 A * 2/2000 Holzer ..... 313/493
6,144,146 A * 11/2000 Cserteg et al. ..... 313/318.01
6,445,131 B1 * 9/2002 Wursching et al. .... 313/318.01

FOREIGN PATENT DOCUMENTS

EP 0 044 196 1/1982
WO 01/01437 1/2001

* cited by examiner

*Primary Examiner*—Ashok Patel
(74) *Attorney, Agent, or Firm*—Carlo S. Bessone

(57) ABSTRACT

A compact low-pressure discharge lamp (1) includes a discharge vessel (3) with electrodes and power supply leads (7), a discharge vessel mount (5) and a cap (12) which has a housing (13), connecting contacts (14) and a mounting plate (15) with a ballast apparatus (16), with the mounting plate (15) being fitted with the ballast arrangement (16) in the interior of the cap housing (13), and having connections for electrical connection of the mounting plate (15) to the power supply leads (7) and to the connecting contacts (14). The discharge vessel mount (5) has an essentially H-shaped cross section and includes a plate (4) with collars (9, 18) running on the edge of each side of the plate. Both the housing (13) of the cap (12) and the cover part, which is in the form of an enveloping bulb (2), a reflector or a closure cap, are mounted on this H-shaped discharge vessel mount (5).

22 Claims, 3 Drawing Sheets

COMPACT LOW-PRESSURE DISCHARGE LAMP

TECHNICAL FIELD

The invention relates to a compact low-pressure discharge lamp comprising a discharge vessel with electrodes and power supply leads, a discharge vessel mount on which the discharge vessel is mounted, and a cap, which comprises a housing, connecting contacts and a mounting plate with a ballast apparatus, with the mounting plate being fitted with the ballast arrangement in the interior of the cap housing, and having connections for electrical connection of the mounting plate to the power supply leads and to the connecting contacts.

BACKGROUND ART

Compact low-pressure discharge lamps such as these may also be provided with a reflector or an enveloping bulb. For relatively high wattages, the discharge vessel in this case comprises a tube which is composed of one or more pieces and is bent a number of times, and which is held in the housing with the aid of a mount part, whose shape is complex and which is composed of plastic or metal. One example of this is described in U.S. Pat. No. 4,456,854.

The mount part, whose shape is complex, for the discharge vessel leads firstly to correspondingly large dimensions for the low-pressure discharge lamp and secondly necessitates manual assembly of the lamp. The production costs for such compact low-pressure discharge lamps are thus relatively high.

DISCLOSURE OF THE INVENTION

The object of the invention is to provide a compact low-pressure discharge lamp of the type mentioned initially, which has a compact structure and can be produced easily, and hence cost-effectively.

In the case of the compact low-pressure discharge lamp according to the invention, the object is achieved by a mount for the discharge vessel having an essentially H-shaped cross section, with the mount comprising a plate with collars which run on the edge of each side of the plate. A cover part on the one hand and the housing of the cap on the other hand are now mounted on this discharge vessel mount.

The cover part may be in the form of an enveloping bulb or a reflector for the discharge vessel. If the compact discharge lamp is to be configured without an enveloping bulb or reflector, this cover part may also be in the form of a closure cap for the cap housing.

In the case of a circular-cylindrical cap housing, the plate of the H-shaped discharge vessel mount is advantageously circular.

The mounting of the discharge vessel is simple if the plate of the discharge vessel mount has two apertures or depressions in the form of half shells for holding the ends of the discharge vessel. The ends can then be mounted on the plate either by means of a hot fusion method, as is described in WO 0,101,437, or in a conventional manner by means of cap cement or adhesive. In the second case, the plate advantageously has a holding edge, for holding the cap cement or adhesive, around the apertures or depressions in the form of half shells, in which case, where apertures are used, the holding edge is advantageously fitted on the side of the plate facing the cap and, where depressions in the form of half shells are used, it is fitted on the side of the plate facing the cover part.

The discharge vessel can also be mounted on the discharge vessel mount by means of a trough, into which a part of the discharge vessel, such as a bend, is inserted. This type of mounting may also additionally be worthwhile for fixing the two ends of the discharge vessel, especially when the discharge vessel is long and has a number of bends.

On the side facing the cap, the plate also preferably has holders for contacts for electrical connection of the power supply leads to the electrical connections of the ballast arrangement on the mounting plate. One example of corresponding contact-making is contained in U.S. Pat. No. 6,008,570, where a cost-effective electrical connection between the power supply leads of the discharge vessel and the connections of the ballast arrangement on the mounting plate is produced by means of spring elements, which are held in holders on the closure cap.

In order to hold the cover part in a simple manner on the H-shaped discharge vessel mount, the latter has an at least partially circumferential groove on the inner face of its casing surface, in which groove formed-out regions, in the form of hooks, of the collar (facing the cover part) on the plate engage.

In order to mount the cap on the H-shaped mount, the cap housing has an at least partially circumferential groove on the inner face of its casing surface, in which groove formed-out regions, likewise in the form of hooks, on the other collar (facing the cap housing) of the plate engage.

Each collar advantageously has between 2 and 8 formed-out regions in the form of hooks. The formed-out regions in the form of hooks in this case have a width of between 1 and 30 mm depending on the cap housing diameter and—with respect to the two collars—are arranged laterally offset with respect to one another, so that the projections of the formed-out regions, in the form of hooks, do not overlap in a plane at right angles to the lamp axis.

One or more relatively broad slots are incorporated in the collars facing the cover part and/or the cap housing, into which slots corresponding mating pieces in the form of ribs on the cover part and/or cap housing engage, thus producing protection against twisting. This avoids forces acting on the formed-out regions, in the form of hooks, when torques act about the lamp axis, so that the formed-out regions need absorb only tensile forces. This avoids the formed-out regions, in the form of hooks, breaking off, and avoids the connection becoming undone.

The formed-out regions in the form of hooks on the two collars are furthermore subdivided into a number of segments by narrow slots which extend as far as the plate. This segmentation leads to a reduction in the joining force. The number and width of the these segments are matched to one another such that, making use of the protection against twisting described above, the strength values required in the relevant Standards are complied with, and the joining forces are in a range which can also easily be coped with for manual assembly.

In addition, apertures can be provided on the plate, for holding tools to engage in. This allows fully automated assembly of the mount plate, fitted with the discharge vessel, together with the cover part, which is in the form of an enveloping bulb, reflector or closure cap, and the cap.

The H-shaped mount is composed of plastic, with the material advantageously being transparent.

The cover part is preferably composed of plastic, in which case, if the cover part is in the form of an enveloping bulb, it may comprise a glass bulb with a plastic edge fitted to it.

The optional configuration of the cover part as an enveloping bulb, reflector or closure cap makes it easy in production to change from compact low-pressure discharge lamps without enveloping bulbs to the same lamp type with an enveloping bulb or reflector. The pure plug-in and latching connections allow the lamp to be assembled very much more easily and fully automatically.

BRIEF DESCRIPTION OF THE DRAWINGS

Further details, features, refinements and advantages can be found in the following description of a number of exemplary embodiments, which are illustrated in drawings, of the subject matter of the invention, in which.

BEST MODE FOR CARRYING OUT THE INVENTION

Figure 1:
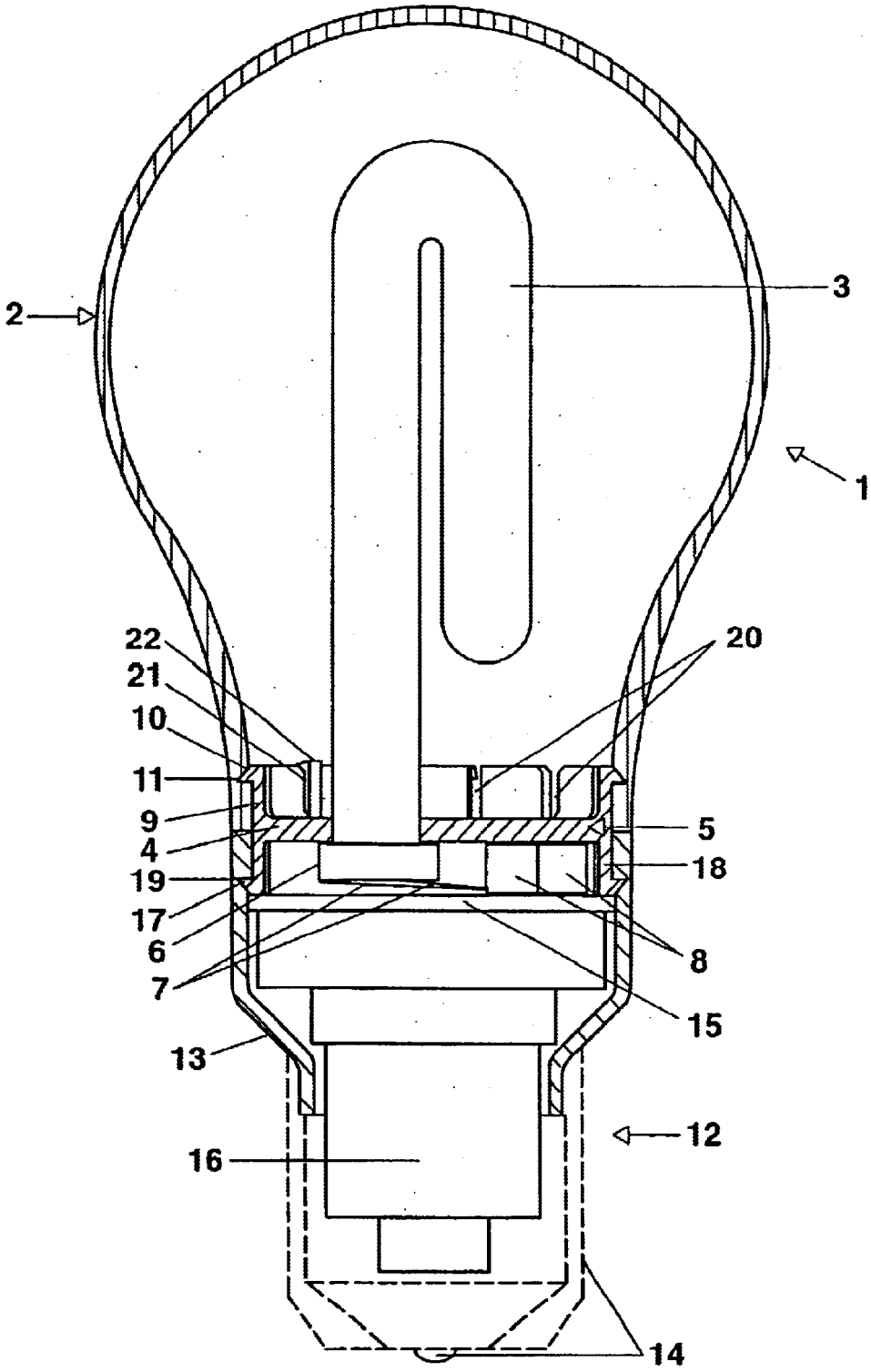
FIG. 1 shows a sectioned side view, illustrated partially schematically, of the low-pressure discharge lamp according to the invention with an enveloping bulb.

FIG. 1 shows a sectioned side view of a compact low-pressure discharge lamp 1 according to the invention with a cover part which is in the form of an enveloping bulb 2 and is composed of plastic. The lamp has a discharge vessel 3 which is wound a number of times and has an amalgam filling. The ends of the discharge vessel are pushed into apertures in the circular plate 4 of an H-shaped discharge vessel mount 5 composed of plastic, and are mounted by means of cap cement (which cannot be seen here) in the holding edge 6 (which is in the form of a bead) around the apertures. The electrodes, which are fused into the ends of the discharge vessel 3, are connected via power supply leads 7 to contacts, which are mounted by means of holders 8 on the H-shaped discharge vessel mount 5.

The H-shaped discharge vessel mount 5 has, on the edge of its plate 4, a collar 9 which extends in the direction of the enveloping bulb 2 and has formed-out regions 10 which are in the form of hooks and engage in an at least partially circumferential groove 11 on the inner wall of the enveloping bulb 2. This creates a connection which cannot be detached by those not skilled in the art between the H-shaped discharge vessel mount 5 and the enveloping bulb 2. Protection against twisting between the enveloping bulb 2 and the discharge vessel mount 5 is achieved by four formed-out regions 10, in the form of hooks, on the collar 9, which engage in corresponding groove sections 11 in the region of the neck of the enveloping bulb 2. As a result of this, when torques are applied, no forces are produced on the formed-out regions which are in the form of hooks and secure the mechanical connection, hence protecting them against damage. The grooves and the formed-out regions in the form of hooks are arranged with 90° symmetry. This ensures that, when the enveloping bulb 2 is fitted, both parts are in the joining position at the latest after being rotated through 90°, and are then connected to one another by application of the joining force. This is advantageous during assembling.

The low-pressure discharge lamp 1 also has an essentially cylindrical cap 12 with a housing 13 and schematically illustrated connecting contacts 14. A mounting plate 15, which is in the form of a circuit board, is located at right angles to the lamp longitudinal axis in the interior of the housing 13. Conductor tracks are formed on the side of the circuit board facing the discharge vessel 3, and the circuit elements of a ballast arrangement 16 (illustrated schematically) are mounted on the side facing away from the discharge vessel 3.

The housing 13 of the cap 12 is connected to the discharge vessel mount 5 via formed-out regions 17, which are in the form of hooks and likewise cannot be detached by those not skilled in the art, on the further annular collar 18, on the side of the plate 4 facing the cap 12, with the formed-out regions 17 in the form of hooks engaging in an at least partially circumferential annular groove 19 on the inner wall of the casing surface of the housing 13. Both collars 9, 18 have a number of narrow slots 20, which are distributed over the circumference, parallel to the axis of symmetry of the H-shaped mount 5, which slots 20 extend as far as the plate 4, as well as broader slots 21, in which the corresponding ribs 22 on the inner casing surface on the neck of the enveloping bulb 2 and on the cap housing 13 engage. The narrow slots are used for segmentation of the formed-out regions, in the form of hooks, and for reducing or adjusting the joining force. The broad slots are likewise used in conjunction with the ribs to provide protection against twisting between the cap 12 and the discharge vessel mount 4, and for correct alignment of the contact elements in the holders 8 with respect to the corresponding contacts on the upper face of the mounting plate 15.

In the embodiment of the discharge vessel mount 5 according to the invention, the formed-out regions in the form of hooks on the collars 9 and 18 are produced such that their projection onto the plane at right angles to the lamp axis has no overlap. This has the advantage that a mould without a slide can be used for injection moulding of the discharge vessel mount 5.

Figure 2:
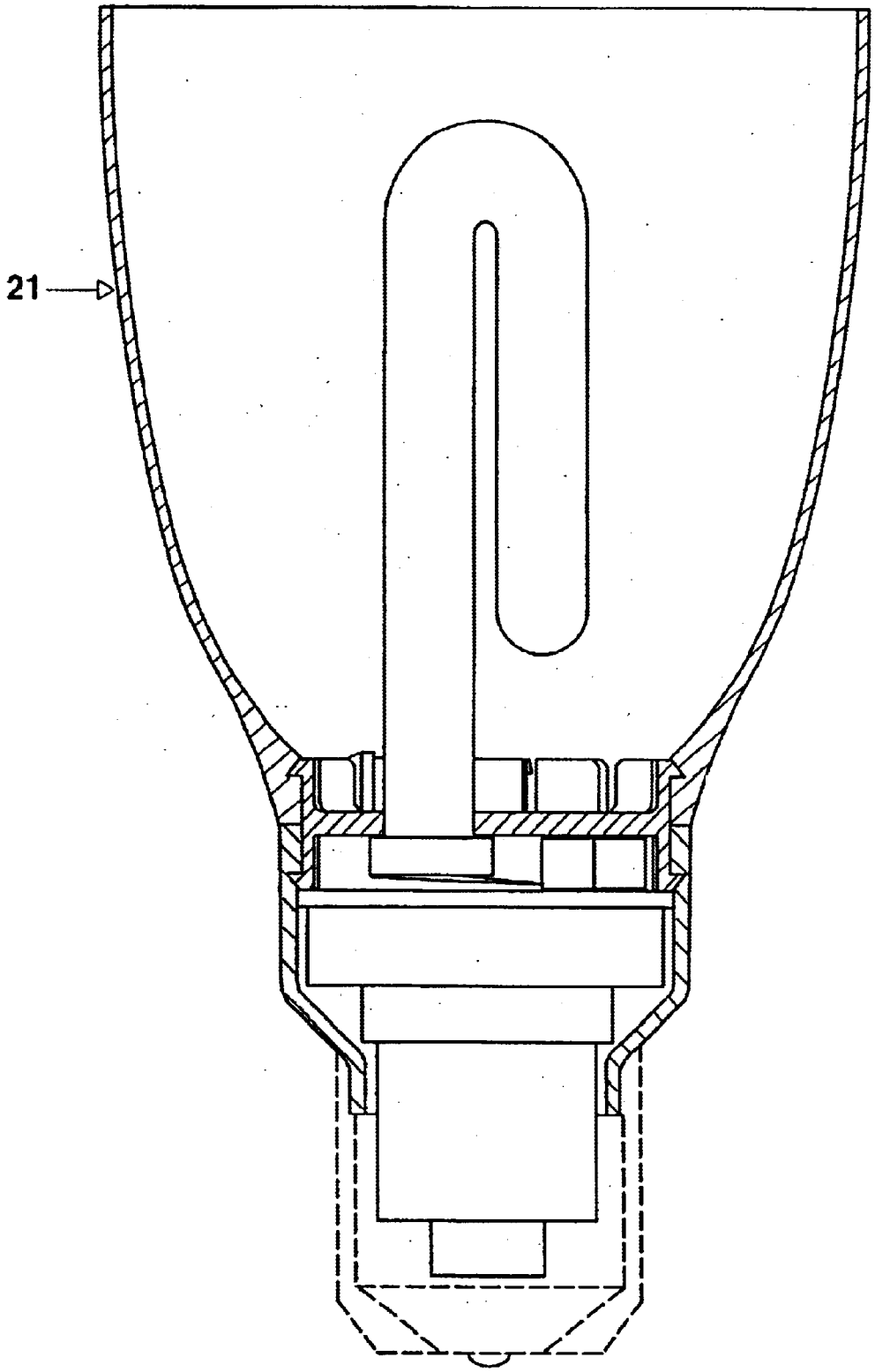
FIG. 2 shows a sectioned side view, illustrated partially schematically, of the low-pressure discharge lamp according to the invention with a reflector.

FIG. 2 shows a low-pressure discharge lamp according to the invention, having a reflector 21. In this case, the cover part is not in the form of an enveloping bulb, but is in the form of a reflector 21. The other components and the way in which these parts are connected correspond to the low-pressure discharge lamp with an enveloping bulb as illustrated in FIG. 1.

Figure 3:
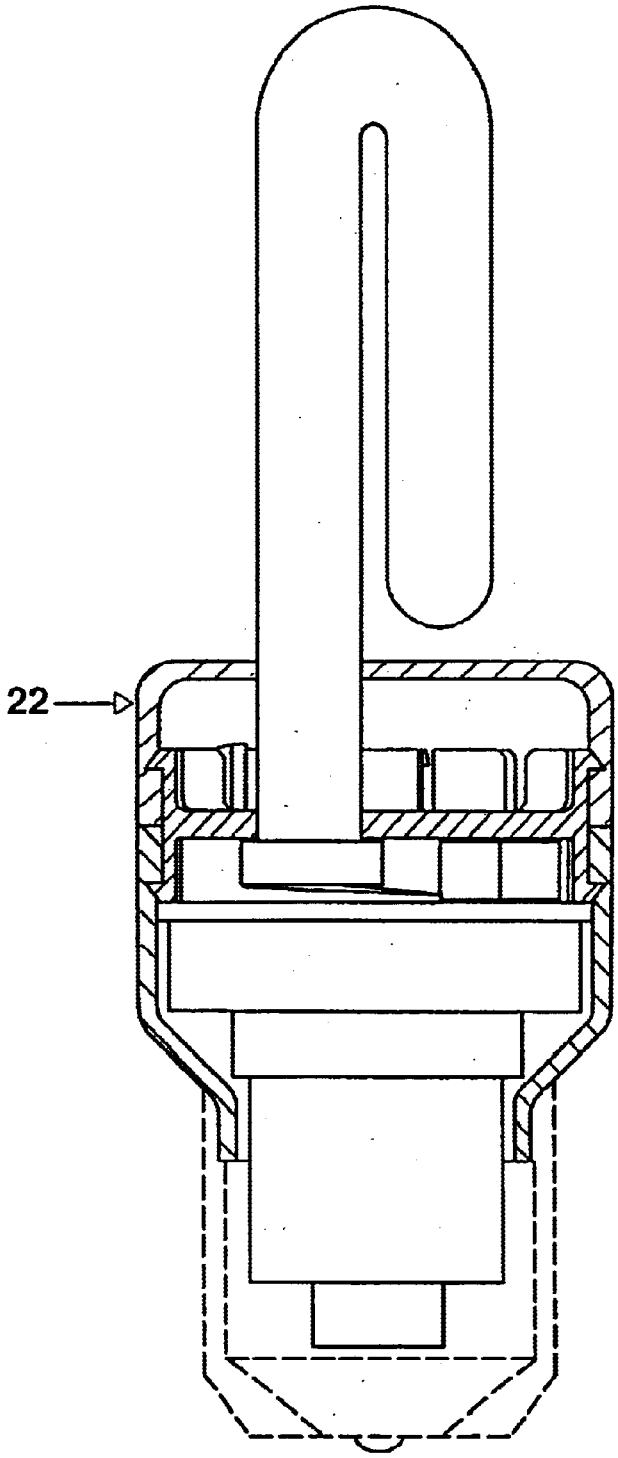
FIG. 3 shows a sectioned side view, illustrated partially schematically, of the low-pressure discharge lamp according to the invention with a closure cap.

FIG. 3 shows a low-pressure discharge lamp according to the invention having only a closure cap 22. The cover part is in this case in the form of a closure cap 22. All the other parts and connections are the same.

What is claimed is:

1. A compact low-pressure discharge lamp comprising a discharge vessel with electrodes and power supply leads a discharge vessel mount on which the discharge vessel is mounted having an essentially H-shaped cross section and comprising a plate with collars running on the edge of each side of the plate, a cover part which is mounted on the one hand of the H-shaped discharge vessel mount, and a cap, which comprises a housing, connecting contacts and a mounting plate with a ballast arrangement, with the mounting plate being fitted with the ballast arrangement in the interior of the cap housing, and having connections for electrical connection of the mounting plate to the power supply leads and to the connecting contacts, the housing of the cap being mounted on the other hand of the H-shaped discharge vessel mount.

2. The low-pressure discharge lamp as claimed in claim 1, in that the cover part is in the form of an enveloping bulb for the discharge vessel.

3. The low-pressure discharge lamp as claimed in claim 1, in that the cover part is in the form of a reflector for the discharge vessel.

4. The low-pressure discharge lamp as claimed in claim 1, in that the cover part is in the form of a closure cap for the cap housing.

5. The low-pressure discharge lamp as claimed in claim 1, in that the plate of the H-shaped mount is circular.

6. The low-pressure discharge lamp as claimed in claim 1, in that the plate of the H-shaped mount has apertures for holding the ends of the discharge vessel.

7. The low-pressure discharge lamp as claimed in claim 1, in that the plate (4) of the H-shaped mount has depressions, in the form of half shells, for holding the ends of the discharge vessel.

8. The low-pressure discharge lamp as claimed in claim 1, in that the plate of the H-shaped mount has at least one trough for fixing a part of the discharge vessel.

9. The low-pressure discharge lamp as claimed in claim 1, in that the plate of the H-shaped mount has holders, on the side facing the cap, for contacts for electrical connection of the power supply leads to the electrical connections of the ballast arrangement on the mounting plate.

10. The low-pressure discharge lamp as claimed in claim 1, in that the plate (4) of the H-shaped mount has apertures for holding tools to engage in.

11. The low-pressure discharge lamp as claimed in claim 6, in that the plate of the H-shaped mount has a holding edge, around the apertures for holding the ends of the discharge vessel, on the side of the plate facing the cap.

12. The low-pressure discharge lamp as claimed in claim 7, in that the plate of the H-shaped mount has a holding edge, around the depressions which are in the form of half shells for holding the ends of the discharge vessel, on the side of the plate facing the cover part.

13. The low-pressure discharge lamp as claimed in claim 1, in that the cover part has an at least partially circumferential groove on the inner face of its casing surface, in which groove formed-out regions, in the form of hooks, on the collar facing the cover part of the plate engage in order to mount the cover part on the H-shaped mount.

14. The low-pressure discharge lamp as claimed in claim 1, in that the cover part is composed of plastic.

15. The low-pressure discharge lamp as claimed in claim 2, in that the cover part is in the form of an enveloping bulb comprising a glass bulb with a plastic neck fitted to it.

16. The low-pressure discharge lamp as claimed in claim 1, in that the cap housing has an at least partially circumferential groove on the inner face of its casing surface, in which groove formed-out regions, in the form of hooks, of the collar facing the cap housing of the plate engage in order to mount the cap housing on the H-shaped mount.

17. The low-pressure discharge lamp as claimed in claim 13, in that the formed-out regions, in the form of hooks, on the collar, which are associated with the cover part and/or the cap housing, of the plate are subdivided into a number of segments by narrow slots which extend as far as the plate.

18. The low-pressure discharge lamp as claimed in claim 13, in that the formed-out regions, in the form of hooks, on the collars associated with the cover part and/or the cap housing of the plate have a width of between 1 and 30 mm.

19. The low-pressure discharge lamp as claimed in claim 13, in that the formed-out regions, in the form of hooks, on the collar associated with the cover part and the cap housing of the plate are offset laterally with respect to one another, such that the projections of the formed-out regions, in the form of hooks, do not overlap in a plane at right angles to the lamp axis.

20. The low-pressure discharge lamp as claimed in claim 13, in that the collar which is associated with the cover part and/or the collar which is associated with the cap housing of the plate has/each have 2 to 8 formed-out regions in the form of hooks.

21. The low-pressure discharge lamp as claimed in claim 1, in that the two collars on the H-shaped mount have a number of broader slots, which are distributed around the circumference, parallel to the axis of symmetry of the H-shaped mount, which slots extend as far as the plate and in which ribs, which are fitted on the inner casing surface of the cover part and/or of the cap housing, engage when the lamp is in the assembled state.

22. The low-pressure discharge lamp as claimed in claim 1, in that the H-shaped mount is composed of plastic.

* * * * *